US005242113A

United States Patent [19]

Manderson

[11] Patent Number: 5,242,113

[45] Date of Patent: Sep. 7, 1993

[54] ROTARY SHOWER HEAD APPARATUS

[76] Inventor: Christopher Manderson, Lynvilla, Carters Way, Chirnside, Berwickshire, Scotland, TD113XQ

[21] Appl. No.: 905,467

[22] Filed: Jun. 29, 1992

[51] Int. Cl.[5] ..... B05B 3/06

[52] U.S. Cl. ..... 239/251; 239/263; 239/381

[58] Field of Search ..... 239/380, 381, 382, 383, 239/392, 394, 251, 259, 263, 552, 264

[56] References Cited

U.S. PATENT DOCUMENTS

| | | | |
|---|---|---|---|
| 2,698,200 | 12/1954 | Bottos | 239/251 |
| 2,761,738 | 9/1956 | Swan | 239/383 |
| 3,563,469 | 2/1971 | Stacey | 239/383 |
| 3,713,587 | 1/1973 | Carson | 239/383 |
| 4,346,844 | 8/1982 | Harmony | 239/381 |
| 4,801,091 | 1/1989 | Sandvik | 239/381 |
| 4,933,999 | 6/1990 | Mikiya et al. | 239/274 |
| 5,070,864 | 12/1991 | Lemons | 239/383 |

*Primary Examiner*—Andres Kashnikow
*Assistant Examiner*—Christopher G. Trainor
*Attorney, Agent, or Firm*—Leon Gilden

[57] ABSTRACT

A shower head is arranged to include a cylindrical skirt having an internal groove rotatably receiving a plate, wherein the plate includes angulated apertures directed therethrough to effect rotation of the plate relative to the shower head when pressurized fluid is directed through the plate.

3 Claims, 4 Drawing Sheets

ROTARY SHOWER HEAD APPARATUS

BACKGROUND OF THE INVENTION

1. Field of the Invention

The field of invention relates to shower head structure, and more particularly pertains to a new and improved rotary shower head apparatus utilizing available water pressure to effect rotation of the plate structure to direct fluid flow in an overlapping manner relative to the shower head.

2. Description of the Prior Art

Various types of massaging and pulsating shower head structure is available in the prior art, typically of a cumbersome structure, wherein the instant invention attempts to overcome deficiencies of the prior art by providing for a shower head arrangement of efficient and compact construction not addressed in the available prior art. Prior art massaging shower head structure is exemplified in the U.S. Pat. Nos. 4,933,999; 4,841,590; 4,801,091; 4,346,844; and 3,563,469.

Accordingly, there remains a need for a new and improved rotary shower head apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of shower head apparatus now present in the prior art, the present invention provides a rotary shower head apparatus wherein the same utilizes rotary plate structure mounted within a shower head to effect undulating fluid flow onto an individual. As such, the general purpose of the present invention, which will be described subsequently in greater detail, is to provide a new and improved rotary shower head apparatus which has all the advantages of the prior art shower head apparatus and none of the disadvantages.

To attain this, the present invention provides a shower head arranged to include a cylindrical skirt having an internal groove rotatably receiving a plate, wherein the plate includes angulated apertures directed therethrough to effect rotation of the plate relative to the shower head when pressurized fluid is directed through the plate.

My invention resides not in any one of these features per se, but rather in the particular combination of all of them herein disclosure and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rotary shower head apparatus which has all the advantages of the prior art shower head apparatus and none of the disadvantages.

It is another object of the present invention to provide a new and improved rotary shower head apparatus which may be easily and efficiently manufactured and marketed.

It is a further object of the present invention to provide a new and improved rotary shower head apparatus which is of a durable and reliable construction.

An even further object of the present invention is to provide a new and improved rotary shower head apparatus which is susceptible of a low cost of manufacture with regard to both materials and labor, and which accordingly is then susceptible of low prices of sale to the consuming public, thereby making such rotary shower head apparatus economically available to the buying public.

Still yet another object of the present invention is to provide a new and improved rotary shower head apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
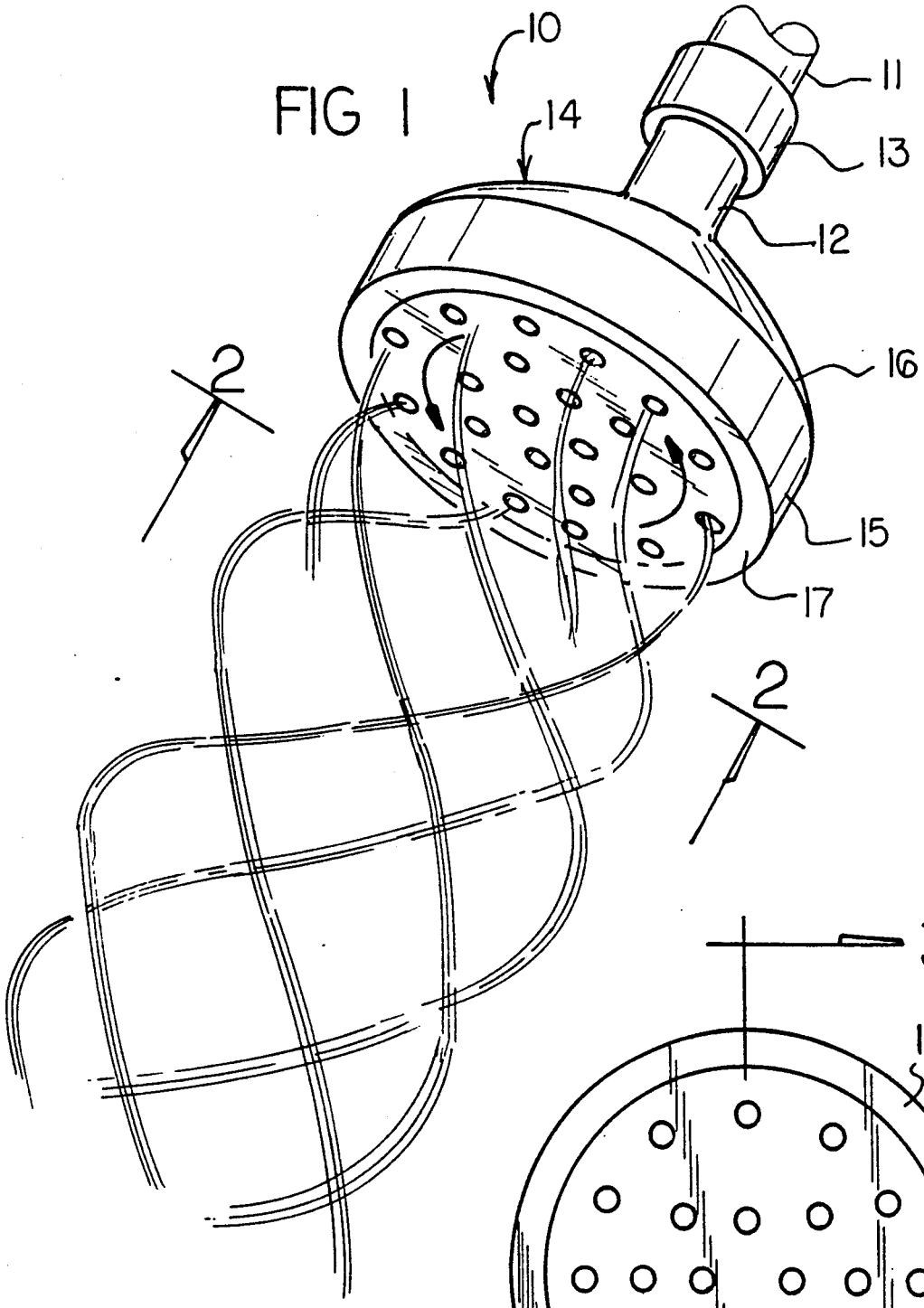
FIG. 1 is an isometric illustration of the instant invention.
Figure 2:
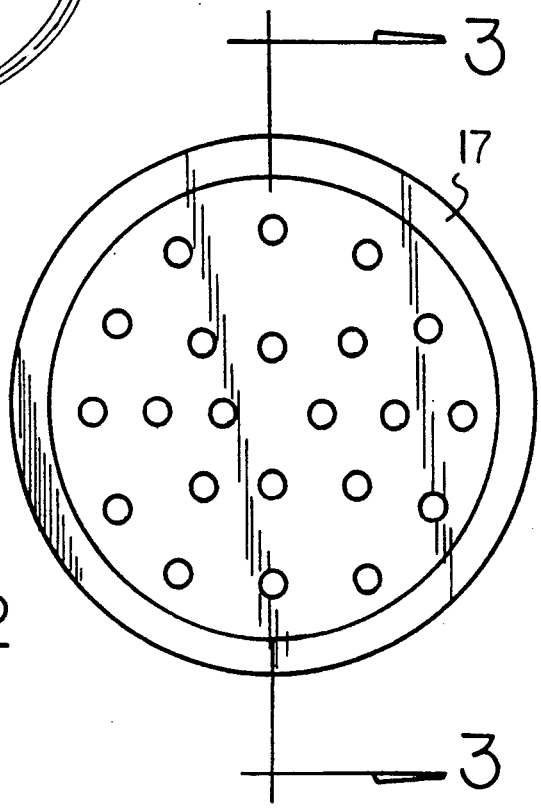
FIG. 2 is an orthographic view, taken along the lines 2—2 of FIG. 1 in the direction indicated by the arrows.
Figure 3:
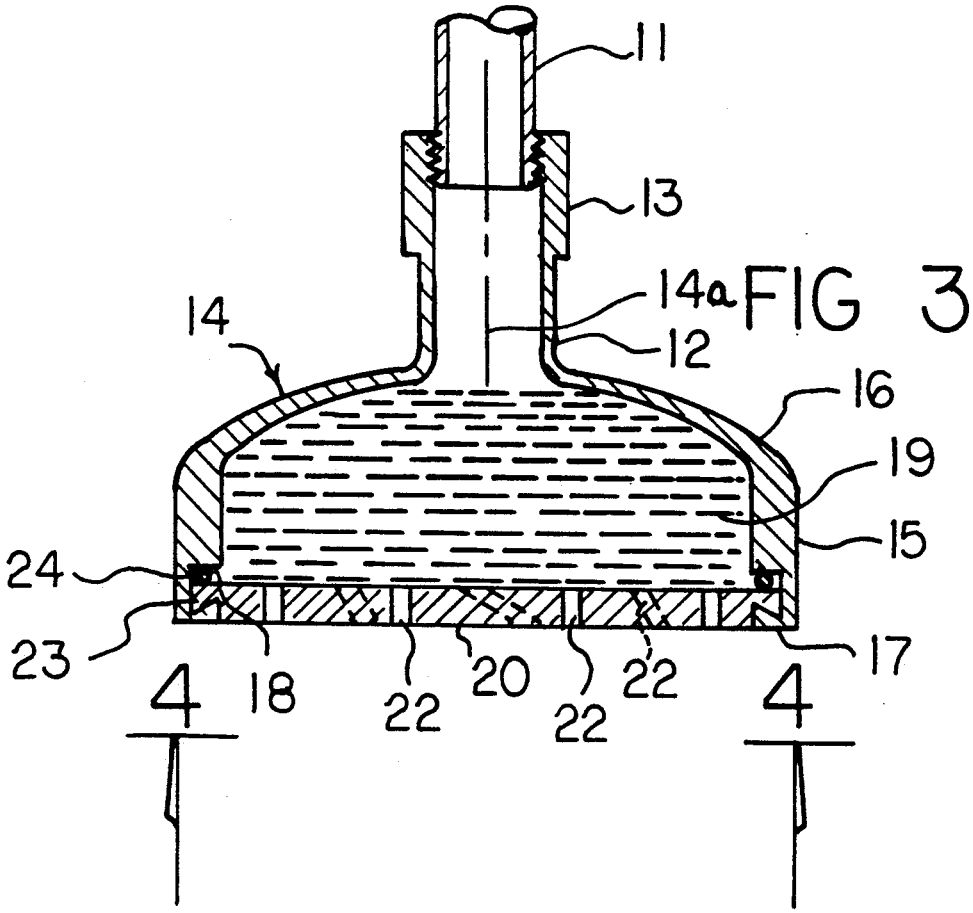
FIG. 3 is an orthographic view, taken along the lines 3—3 of FIG. 2 in the direction indicated by the arrows.
Figure 4:
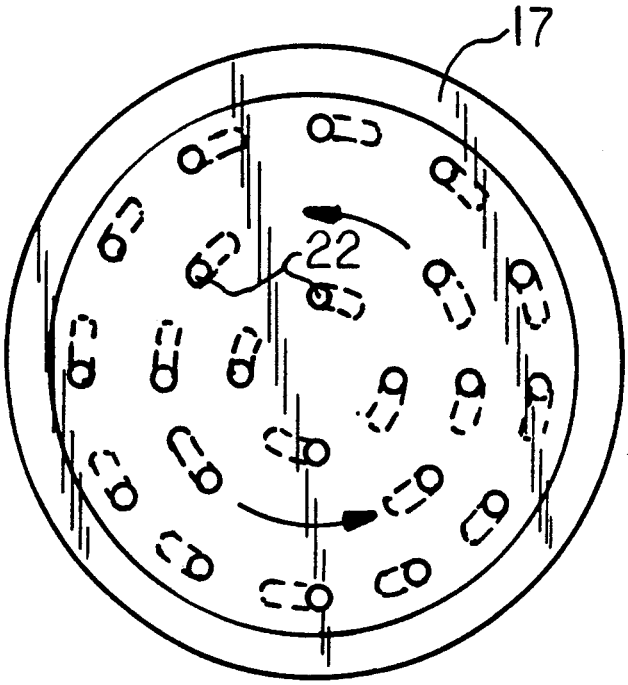
FIG. 4 is an orthographic view, taken along the lines 4—4 of FIG. 3 in the direction indicated by the arrows.

With reference now to the drawings, and in particular to FIGS. 1 to 10 thereof, a new and improved rotary shower head apparatus embodying the principles and concepts of the present invention and generally designated by the reference numeral 10 will be described.

Figure 5:
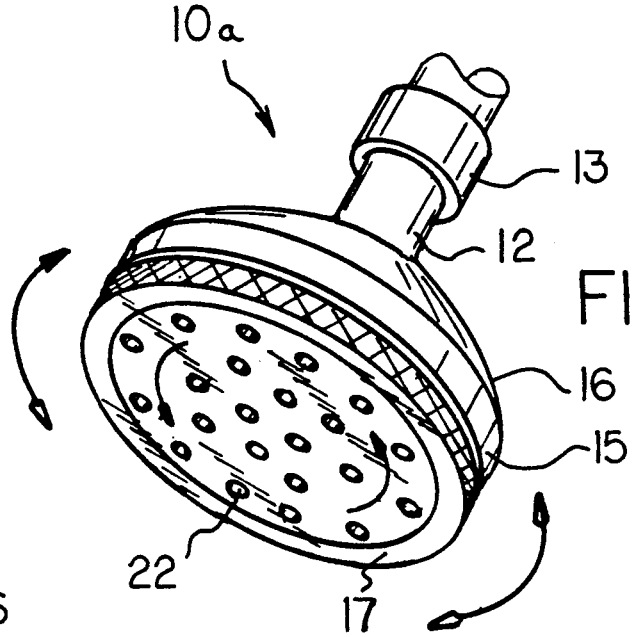
FIG. 5 is an isometric illustration of a clamping arrangement utilized for mounting the rotary plate structure of the invention.
Figure 7:
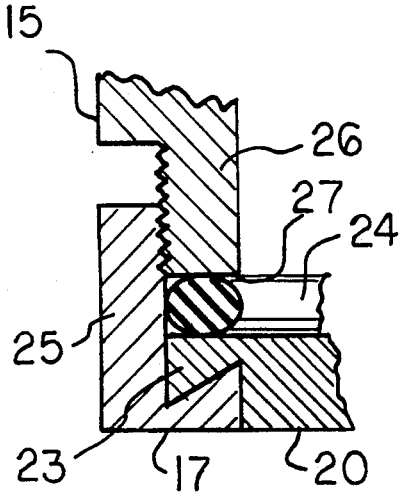
FIG. 7 is an enlarged orthographic view of section 7 as set forth in FIG. 6.
Figure 6:
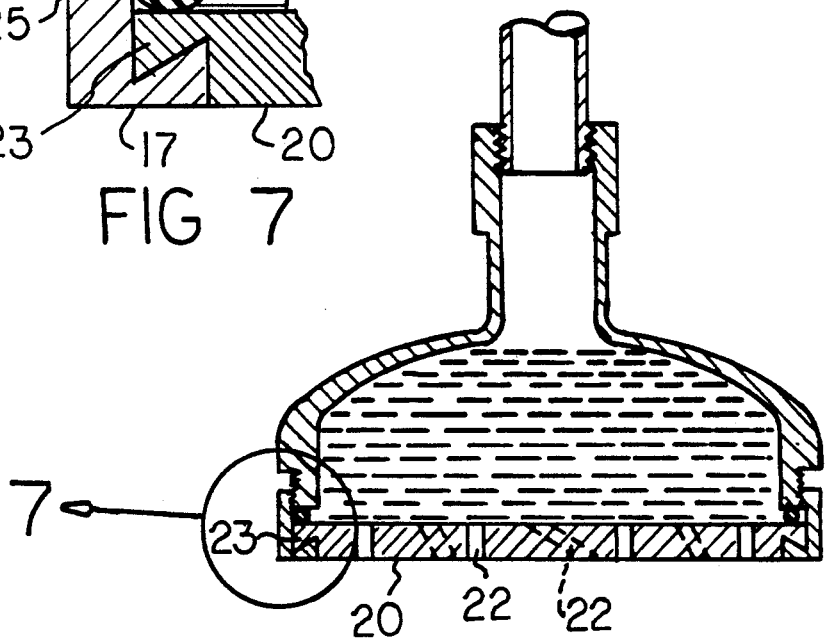
FIG. 6 is an orthographic cross-sectional illustration of the invention as set forth in FIG. 5.

More specifically, the rotary shower head apparatus 10 of the instant invention essentially comprises securement to a water conduit 11 by use of a shower head conduit 12 having a coupling 13 mounted to the water conduit 11. A shower head housing 14 is provided symmetrically defined about a housing axis 14*a*, with a housing cylindrical side wall 15 and a generally convex top wall 16 relative to a housing cavity 19 within the housing 14. An annular flange 17 is orthogonally mounted to a lower end of the side wall 15 spaced from the top wall, with the annular flange having an annular flange groove 18 oriented above the annular flange 17, wherein the annular groove 18 slidably receives an annular plate flange 23 of a rotary cylindrical plate 20 mounted rotatably to the annular flange, with a sealing ring 24 captured between the plate flange 23 within the annular groove 18. The rotary cylindrical plate 20 includes a matrix of plate apertures 21 directed through the rotary plate at an acute included angle relative to the rotary plate, wherein the rotary plate apertures are symmetrical about the axis 14*a* and directed through the plate in a first orientation. In this manner, fluid projected through the plate apertures 21 effects a spinning of the rotary plate as the apertures are all of a like first orientation directed at a predetermined acute angle relative to a bottom surface of the plate 20. The FIGS. 5-7 illustrate a construction to adjust rotation of the plate, where if desired to prevent such rotation to form the annular flange 17 with an annular flange internally threaded skirt 25 parallel to the side wall 15, with the annular flange internally threaded skirt 25 cooperative with an externally threaded side wall skirt extension that has a skirt lower wall 27 in engagement with the sealing ring 24 to capture the sealing ring between the skirt lower wall 27 that, as illustrated in FIG. 7, is oriented orthogonally relative to the axis 14*a* and is positioned over the flange 17, whereupon threaded projection of the annular flange internally threaded skirt 25 to the skirt extension 26 effects compressing of the sealing ring 24 to permit arresting of movement of the rotary cylindrical plate 20 relative to the housing 14.

Figure 8:
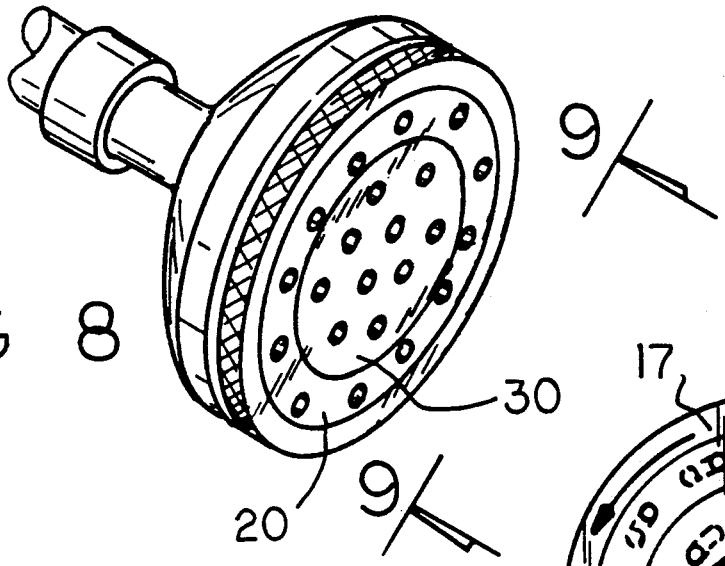
FIG.8 is an isometric illustration of a dual plate shower head structure utilized by the invention.
Figure 9:
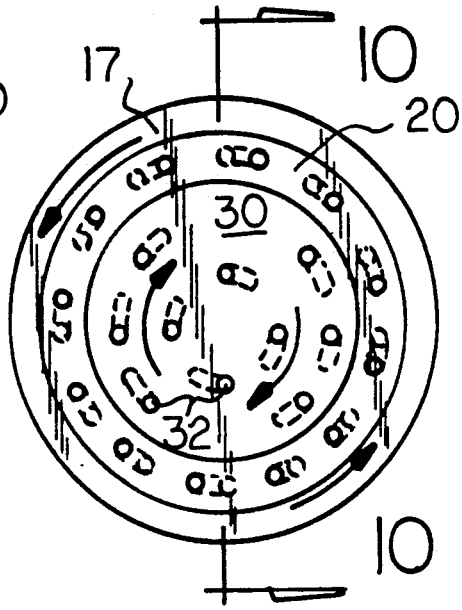
FIG. 9 is an orthographic view, taken along the lines 9—9 of FIG. 8 in the direction indicated by the arrows.
Figure 10:
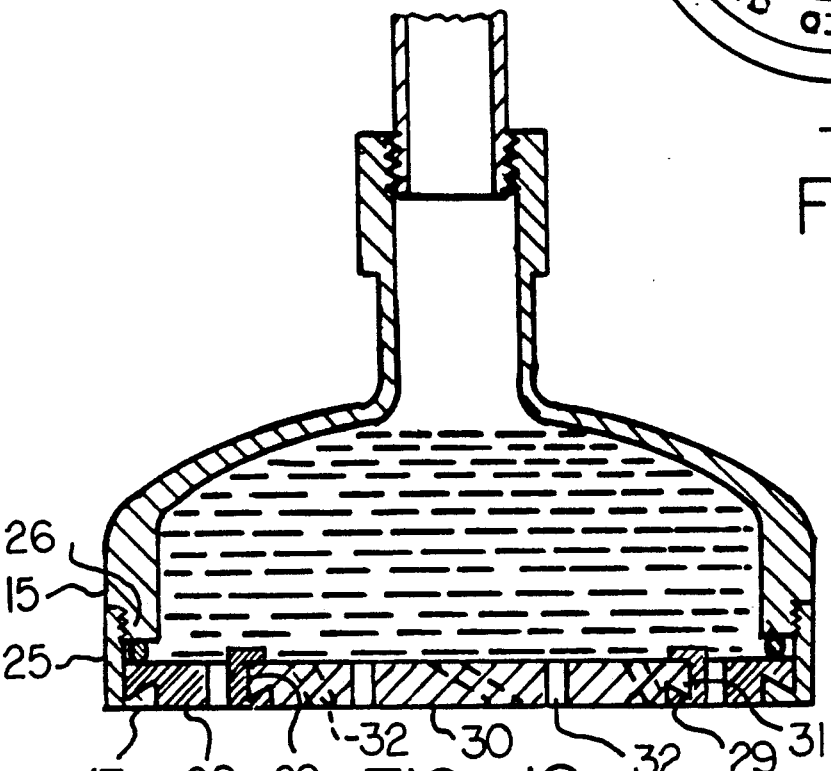
FIG. 10 is an orthographic view, taken along the lines 10—10 of FIG. 9 in the direction indicated by the arrows.

The FIG. 8 additionally provides for the rotary cylindrical plate 20 formed with a rotary plate central bore 28 having a central bore flange 29 projecting into the central bore 28 rotatably mounting a central plate 30, wherein the central plate 30 includes central plate flange 31 slidably and rotatably mounted upon the rotary plate central bore 28, with central plate apertures 32 directed and inclined at said acute angle through the central plate, wherein the central plate apertures are inclined at a second orientation orthogonally oriented relative to the first orientation of the rotary plate apertures to effect contra-rotation of the central plate relative to the rotary plate 20 to provide for enhanced sensation of pulsation onto an individual due to the contra-rotating plates and the contra-undulating fluid flow onto the individual.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rotary shower head apparatus, comprising, a shower head, the shower head having a shower head housing, and a shower head conduit directed into the shower head housing, with the shower head housing including a top wall receiving the shower head conduit, and the shower head housing symmetrically formed about a housing axis, with a cylindrical side wall arranged concentrically about the housing axis, and the cylindrical side wall including a side wall lower distal end, and the side wall lower distal end including an annular flange orthogonally oriented relative to the housing axis, the annular flange and side wall defining an annular groove positioned above the annular flange and directed into the side wall within the housing, and a rotary cylindrical plate having a plate flange rotatably mounted on the annular flange within the annular groove, and the cylindrical plate including a matrix of apertures directed through the cylindrical plate, the plate flange including a planar bottom wall, and the plate apertures intersecting the planar bottom wall at a predetermined acute angle defining a first orientation, with the apertures symmetrically oriented through the rotary cylindrical plate about the housing axis.

2. An apparatus as set forth in claim 1 wherein the annular flange includes an annular flange internally threaded skirt orthogonally oriented relative to the annular flange, and the side wall includes a side wall skirt extension having an externally threaded surface, wherein the externally threaded surface is cooperative with the annular flange internally threaded skirt, and the skirt extension includes a skirt lower wall oriented over the annular flange, and a sealing ring captured between the skirt lower wall and the plate flange to provide for relative adjustment of rotation of the rotary cylindrical plate by rotating the annular flange internally threaded skirt relative to the skirt extension.

3. An apparatus as set forth in claim 2 wherein the rotary cylindrical plate includes a rotary plate central bore and the central bore includes a central bore flange orthogonally oriented relative to the axis, with the central bore concentric relative to the axis and a central plate rotatably mounted on the central bore flange, the central plate including a central plate flange positioned and rotatably mounted on the central bore flange, and the central plate further including a matrix of central plate apertures symmetrically directed through the central plate about the housing axis, with the central plate including central plate bottom surface and the bottom surface coplanar with the rotary plate bottom wall, and the matrix of central plate apertures directed through said central plate inclined at said predetermined acute angle relative to the central plate bottom surface orthogonally oriented relative to said rotary plate apertures defining a second orientation orthogonally oriented relative to said first orientation.

* * * * *